US009133851B2

(12) United States Patent
Ebisawa et al.

(10) Patent No.: US 9,133,851 B2
(45) Date of Patent: Sep. 15, 2015

(54) CONTROL DEVICE AND CONTROL METHOD OF COMPRESSOR

(75) Inventors: Naoto Ebisawa, Ushiku (JP); Kitami Suzuki, Abiko (JP); Hideaki Orikasa, Tsuchiura (JP); Keiichi Hiwatari, Tsuchiura (JP); Takeshi Miyanaga, Kasumigaura (JP)

(73) Assignee: Hitachi, Ltd., Tokyo (JP)

( * ) Notice: Subject to any disclaimer, the term of this patent is extended or adjusted under 35 U.S.C. 154(b) by 481 days.

(21) Appl. No.: 13/370,527

(22) Filed: Feb. 10, 2012

(65) Prior Publication Data

US 2012/0207622 A1 Aug. 16, 2012

(30) Foreign Application Priority Data

Feb. 10, 2011 (JP) ..... 2011-027425

(51) Int. Cl.
*F04D 27/02* (2006.01)
*F04D 27/00* (2006.01)

(52) U.S. Cl.
CPC ..... *F04D 27/001* (2013.01); *F04D 27/0223* (2013.01)

(58) Field of Classification Search
CPC . F04D 15/0005; F04D 15/0011; F04D 15/02; F04D 15/0245; F04D 15/0254; F04D 27/001; F04D 27/0207; F04D 27/0215; F04D 27/0223; F04D 27/009; F04D 17/14
USPC ..... 417/53, 63, 278, 300, 304, 307, 309
See application file for complete search history.

(56) References Cited

U.S. PATENT DOCUMENTS

| | | | | |
|---|---|---|---|---|
| 4,164,034 | A * | 8/1979 | Glennon et al. | 701/100 |
| 4,228,650 | A * | 10/1980 | Camp | 60/39.091 |
| 4,946,343 | A * | 8/1990 | Blotenberg | 415/27 |
| 2007/0100478 | A1 * | 5/2007 | Egeland et al. | 700/45 |
| 2008/0101914 | A1 * | 5/2008 | Chen et al. | 415/1 |
| 2009/0274565 | A1 * | 11/2009 | White | 417/282 |
| 2010/0089067 | A1 | 4/2010 | Wilkes et al. | |
| 2011/0167025 | A1 * | 7/2011 | Danai et al. | 706/12 |
| 2012/0183385 | A1 * | 7/2012 | Narayanan et al. | 415/1 |

FOREIGN PATENT DOCUMENTS

| | | |
|---|---|---|
| EP | 0 500 195 A2 | 8/1992 |
| JP | 06-346893 | 12/1994 |
| JP | 11-506184 | 6/1999 |
| JP | 2009-47059 | 3/2009 |
| WO | WO 97/24591 A1 | 7/1997 |
| WO | WO 2010/141815 | 12/2010 |

OTHER PUBLICATIONS

JP Office Action for Japanese Application No. 2011-027425, issued on Mar. 4, 2014.

* cited by examiner

*Primary Examiner* — Bryan Lettman
*Assistant Examiner* — Charles W Nichols
(74) *Attorney, Agent, or Firm* — Jones Robb PLLC

(57) ABSTRACT

A control device of a compressor includes a valve control unit configured to control an anti-surge valve that returns fluid in a discharge side of the compressor to a suction side of the compressor in accordance with a control parameter, a simulation unit configured to simulate operational status of the compressor in a plant in accordance with a plant model and the control parameter of the plant to which the compressor is installed, and a control parameter adjusting unit configured to adjust the control parameter in accordance with a result of the simulation.

6 Claims, 11 Drawing Sheets

RESULT WHEN $G_P=1$, $G_I=0$, $G_D=0$

RESULT WHEN $G_P=20$ ($K_C=20, T_C=2$)

RESULT WHEN $G_P=11.8$, $G_I=1.0$, $G_D=0.25$

CONTROL DEVICE AND CONTROL METHOD OF COMPRESSOR

CROSS REFERENCE TO RELATED APPLICATIONS

The present application claims benefit of the filing date of Japanese Patent Application No. 2011-027425 filed on Feb. 10, 2011, which is incorporated herein by reference.

BACKGROUND OF THE INVENTION

1. Field of the Invention

The present invention relates to a control device and control method of a compressor.

2. Description of the Related Art

A process compressor (hereinafter called a "compressor") is widely used for providing compressed gas in various types of plants such as plants in petrochemistry field. A compressor must be appropriately controlled to provide a stable discharge pressure or discharge flow rate required for a downstream process. However, when the flow rate becomes lower than a certain threshold, an unstable phenomenon called "surge" occurs in the compressor. Here, the surge means a vibration phenomenon that is accompanied by a pressure fluctuation or a backward flow in the compressor.

In general, an anti-surge valve is used for prevention of a surge or a breakaway from a surge in a compressor. By opening the anti-surge valve to return gas from the discharge side to the suction side, it is possible to stabilize the behavior of the compressor. In other words, the anti-surge valve is used to prevent the operating point of the compressor from entering a surge region or to shift over from the surge region to the operative region. As a control method of an anti-surge valve of a compressor, PID control is generally used to keep or shift the operating point on the operative region side from the surge control line on an HQ map. Meanwhile, the surge region and surge control line in a compressor will be explained later.

In Japanese Unexamined Patent Application Publication (Translation of PCT Application) No. JP1999-506184, there is described a control system including: a PID control module that responds to a control variable (which corresponds to an "operating point" in the present invention), and a velocity control module that responds to a velocity signal which shows a velocity to a surge control line. In addition, JP1999-506184 describes that the control system is provided with an output signal selector for selectively outputting the first output signal outputted by the PID control module and the second output signal outputted by the velocity control module to an anti-surge valve.

In Japanese Unexamined Patent Application Publication No. JP2009-47059, there is described an operational method of a motor-driven compressor which controls the opening degree of an inlet guide vane of the compressor, and shifts the operating point of the compressor along a control line for start-up.

Here, the control line for start-up is set parallel to the surge line in the performance curve of the compressor and in the operative region side relative to the surge control line.

The control system of the compressor of JP1999-506184 is described with a case in which the compressor is operated on the premise that the compressor system has been designed under optimal conditions. However, the operational status of the compressor changes in accordance with the conditions of gas treated by the compressor and seasonal changes. In other words, when the control system described in JP1999-506184 is applied to an actual compressor system, the operator of the compressor is required to adjust PID parameters for anti-surge control by the try-and-error method.

Similarly, the operational method of a motor-driven compressor described in JP2009-47059 is based on the premise that the compressor system has been designed under optimal conditions. Accordingly, also in the invention described in JP2009-47059, the operator of the compressor is required to adjust PID parameters for anti-surge control by the try-and-error method.

Here, adjusting PID parameters for anti-surge control plays a key role in the start-up process of the compressor.

Accordingly, the present invention addresses providing a control device and control method of a compressor, which are capable of saving efforts of adjustment.

SUMMARY OF THE INVENTION

For solving the problem described above, a control device of a compressor according to the present invention includes: a valve control unit configured to control an anti-surge valve that returns fluid on a discharge side of the compressor to a suction side in accordance with a control parameter; a simulation unit configured to perform simulation of operational status of the compressor in a plant in accordance with a plant model and the control parameter of the plant in which the compressor is installed; and a control parameter adjusting unit configured to adjust the control parameter in accordance with a result of the simulation.

Further, a control method of a compressor according to the present invention includes: at the simulation unit, simulating operational status of the compressor in a plant in accordance with a plant model of the plant to which the compressor is installed and the control parameter; at the control parameter adjusting unit, adjusting the control parameter in accordance with a result of the simulation; at the control parameter setting unit, setting a valve control parameter adjusted by the control parameter adjusting unit as a valve control parameter to be used by the valve control unit when controlling the plant; and at the valve control unit, controlling the anti-surge valve in accordance with the valve control parameter set by the control parameter setting unit.

According to the invention, it is possible to provide a control device and control method of a compressor, which is capable of saving the effort of adjustment.

BRIEF DESCRIPTION OF THE DRAWINGS

FIG. 6A is a diagram of HQ characteristics; FIG. 6B is an explanatory diagram showing a transition of a suction flow rate and a surge flow rate of the compressor as time goes on; FIG. 6C is an explanatory diagram showing a transition of the opening degree of the anti-surge valve as time goes on;

FIG. 7A is a diagram of HQ characteristics; FIG. 7B is an explanatory diagram showing a transition of a suction flow rate and a surge flow rate of the compressor as time goes on; FIG. 7C is an explanatory diagram showing a transition of the opening degree of the anti-surge valve as time goes on;

FIG. 8A is a diagram of HQ characteristics; FIG. 8B is an explanatory diagram showing a transition of a suction flow rate and a surge flow rate of the compressor as time goes on; FIG. 8C is an explanatory diagram showing a transition of the opening degree of the anti-surge valve as time goes on;

DETAILED DESCRIPTION OF THE PREFERRED EMBODIMENT

First Embodiment

Figure 1:
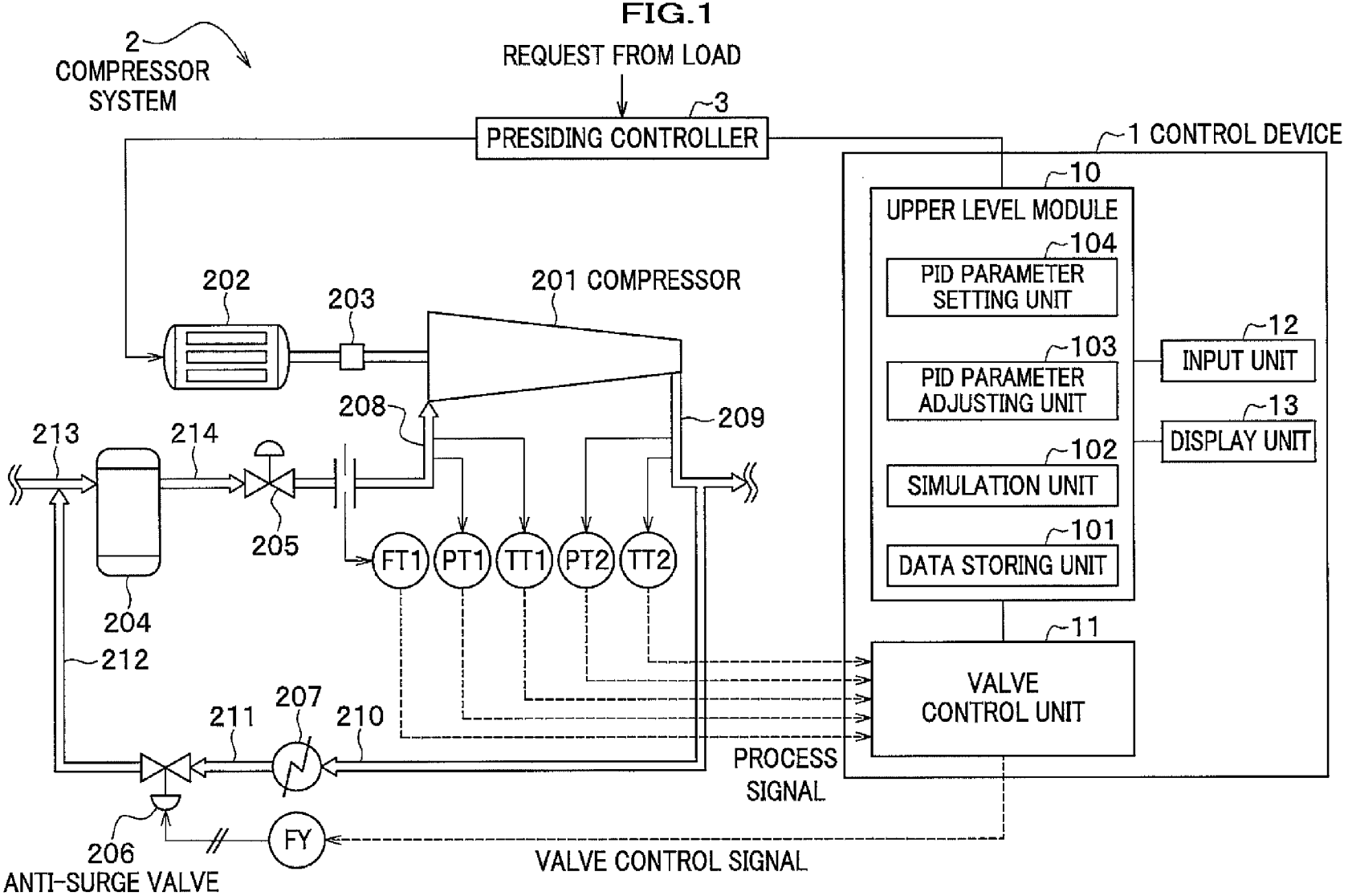
FIG. 1 is a block diagram of a compressor system including a control device of a compressor according to the first embodiment of the invention.

In a control device 1 according to the embodiment, as shown in FIG. 1, a simulation unit 102 of an upper level module 10 simulates operational status of a compressor 201 in a compressor system 2 on the basis of a plant model, and a PID parameter adjusting unit 103 adjusts a valve control parameter on the basis of the simulation result.

Here, the plant model represents a model that corresponds to each component of the actual compressor system 2 and the relations thereof, and the details of the plant model will be explained later.

Configuration of the Compressor System

First, will be explained a configuration of the control device 1 according to each embodiment of the present invention and the compressor system 2 that includes an anti-surge valve 206 which is to be controlled by the control device 1. FIG. 1 is a block diagram of the compressor system including the control device of the compressor according to the embodiment.

A single-axis multistage centrifugal compressor (hereinafter called a compressor 201) is connected to a drive motor 202 via a transmission 203. A suction side pipe 208 or a discharge side pipe 209 is connected to the suction port or discharge port of the compressor 201 respectively. A suction throttle valve 205 is attached to the suction side pipe 208, and the suction flow rate of the compressor 201 is adjusted by adjusting the opening degree of the suction throttle valve 205. In addition, a suction drum 204 is disposed upstream of the suction throttle valve 205 for separating liquid from gas, and is connected to the suction throttle valve 205 via a pipe 214.

On the discharge side pipe 209 of the compressor 201, there are provided return pipes 210, 211 and 212 branching therefrom for returning gas to the suction side of the compressor 201. The anti-surge valve 206 is located between the return pipes 211 and 212, and returns gas from the discharge side to the suction side of the compressor 201 to prevent surge at the compressor 201 from occurring. In addition, a heat exchanger 207 is located between the return pipes 210 and 211, and cools gas compressed and heated by the compressor 201. Further, a flow sensor FT1, a pressure sensor PT1, and a temperature sensor TT1 are attached to the suction side pipe 208 of the compressor 201. The flow sensor FT1 detects the flow rate of gas flowing into the compressor 201 (hereinafter called a suction flow rate $Q_S$). The flow sensor FT1 is an Orifice type or Venturi tube type for example.

The pressure sensor PT1 detects the pressure of gas flowing into the compressor 201 (hereinafter called a suction pressure Ps). The temperature sensor TT1 detects a temperature of gas flowing into the compressor 201 (hereinafter called a suction temperature Ts). Meanwhile, a pressure sensor PT2 and a temperature sensor TT2 are attached to the discharge side pipe 209 of the compressor 201. The pressure sensor PT2 detects the pressure of gas discharged from the compressor 201 (hereinafter called a discharge pressure Pd). The temperature sensor TT2 detects the temperature of gas discharged from the compressor 201 (hereinafter called a discharge pressure Td). Output signals Qs, Ps, Ts, Pd and Td (hereinafter called a "process signal") from the flow sensor FT1, the pressure sensors PT1 and PT2, and the temperature sensors TT1 and TT2 are inputted to the valve control unit 11 of the control device 1. The valve control unit 11 outputs a valve control signal for controlling the opening degree of the anti-surge valve 206 using the PID control on the basis of the process signal.

A converter FY converts the valve control signal, which is an electric signal outputted from the valve control unit 11, into an analog signal, and adjusts the opening degree of the anti-surge valve 206 using air pressure for example.

Meanwhile, the rotational speed of a drive motor 202 is controlled by a presiding controller 3 according to a request from load in a plant located downstream of the pipe 209. In FIG. 1, illustrations are omitted in the upstream of the confluence point of the pipe 213 and return pipe 212 and in the downstream of the branch point of the return pipe 210 and the discharge side pipe 209.

Gas sent from an upstream process via the pipe 213 flows into the compressor 201 through the suction side pipe 208, and is compressed and pressurized by a rotating impeller (not shown) and then sent to a downstream process through the discharge side pipe 209. Usually, during normal operation of the compressor system 2, the anti-surge valve 206 is totally closed. In other words, the flow rate of gas returning from the discharge side to the suction side of the compressor 201 is zero. However, when starting up or stopping the compressor 201, or when something changed in the upstream or downstream process, the anti-surge valve 206 is opened since there is a possibility of a surge in the compressor 201.

HQ Characteristics

Figure 2:
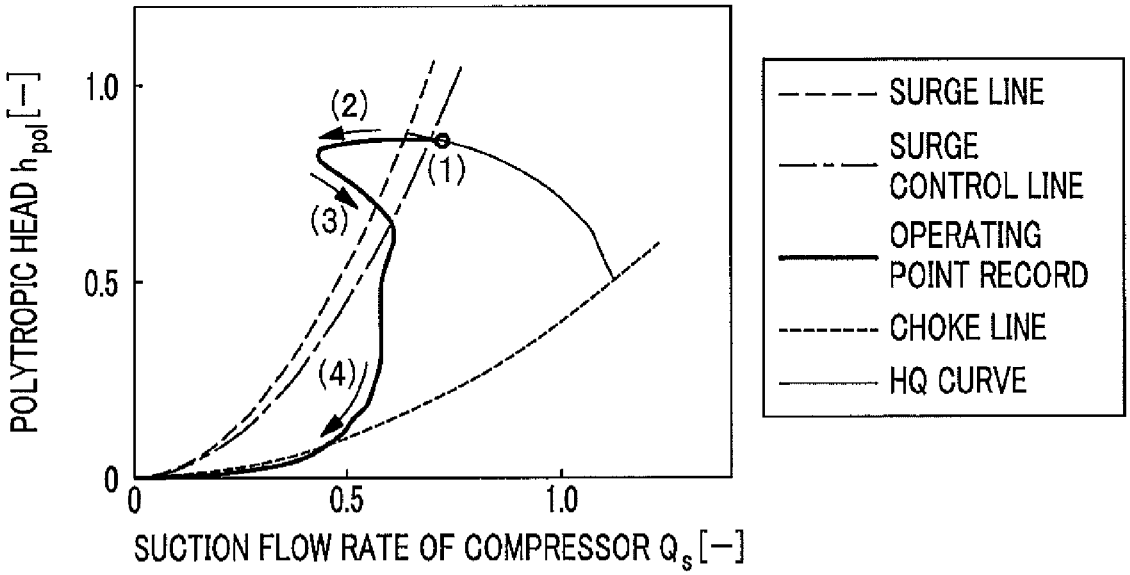
FIG. 2 is an HQ map which represents the relation between a suction flow rate of a compressor and polytropic head.

FIG. 2 is an HQ map which represents the relation between the suction flow rate of a compressor and polytropic head. The valve control unit 11 calculates an operating point ($Q_s$, $h_{po1}$) on the HQ map using process signals (suction flow rate $Q_s$, suction pressure $P_s$, suction temperature $T_s$, discharge pressure $P_d$, and discharge temperature $T_d$) which are output signals from the detectors (FT1, PT1, PT2, TT1, TT2). In FIG. 2, the record of the operating point is shown with a bold solid line.

Here, the HQ map represents a relationship between the suction flow rate $Q_s$ of the compressor 201 and the polytropic head $h_{pol}$. In addition, the compressor suction flow rate $Q_s$ in FIG. 2 is made dimensionless by making the suction flow rate at a rated point of the compressor 201 being 1.0. Similarly, the polytropic head $h_{pol}$ in FIG. 2 is made dimensionless by making the polytropic head at the specified point of the compressor 201 being 1.0. The surge line denotes the surge limit of the compressor 201. A surge occurs when the operating point of the compressor 201 on the HQ map enters the surge region which is the region located on the left side of the surge line shown in broken line.

As shown in FIG. 2, a line with a predetermined margin in the operating region which is located in the right hand side of the surge line is called a surge control line. The valve control unit 11 performs a closed loop calculation of the PID control such that the operating point does not enter the left hand side of the surge control line, and generates a valve control signal for the anti-surge valve 206. The converter FY takes in the valve control signal, which is the calculation result of the PID control, and adjusts the opening degree (0 to 100%) of the anti-surge valve 206 in accordance with the calculation result. In the example shown in FIG. 2, the operating point of the compressor 201 enters the surge region during the stage from an operating point (1) to the arrow (2). Then, the suction flow rate is ensured by opening the anti-surge valve 206 in accordance with a command from the valve control unit 11, and the operating point of the compressor 201 is returned to the operative region as shown by arrows (3) and (4).

Meanwhile, the PID control may be performed using a conventional technique, and therefore the explanation will be omitted.

Configuration of Control Device

Now returning to FIG. 1, the configuration of the control device 1 will be explained. The control device 1 is provided with a valve control unit 11, an input unit 12, a display unit 13 and an upper level module 10.

Valve Control Unit

The valve control unit 11 always takes in the process signals during the operation of the compressor 201 and calculates an operating point (a value of the polytropic head $h_{pol}$ corresponding to the suction flow rate $Q_s$ of the compressor 201) (see FIG. 2). When a surge is likely to occur or when a surge has occurred, the valve control unit 11 outputs a valve control signal to the converter FY on the basis of the PID control. The converter FY opens the anti-surge valve 206 in accordance with the valve control signal, and returns the gas from the compressor 201 from the discharge side pipe 209 to the suction side pipe 208. Thus the valve control unit 11 ensures the suction flow rate $Q_s$ of the compressor 201 by controlling the opening degree of the anti-surge valve 206, and keeps the operation of the compressor 201 within the operative region which is a region on the right hand side of the surge control line on the HQ map.

The valve control unit 11, of which the control target is the anti-surge valve 206 of the compressor system 2, takes in the process signals from the compressor system 2 and outputs a valve control signal in accordance with the PID control based on a predetermined PID parameter.

On the other hand, when installing the control device 1 or starting-up the compressor 201 after upgrading the compressor system 2 for example, it is necessary to tune the PID parameter of the valve control unit 11. In such a case, the control device 1 performs a simulation based on a plant model of the upper level module 10, and adjusts PID parameters in accordance with the result of the simulation and set the PID parameters as new PID parameters for the valve control unit 11.

Note that a user of the control device 1 may select whether or not to tune the PID parameters by operating an input unit 12.

Input Unit

To be more precise, the input unit 12 (see FIG. 1) may be a keyboard or a mouse or the like, and inputs data by the user of the control device 1. Through the input unit 12, input data such as various preset values or initial values of the plant model are inputted to the data storing unit 101 of the upper level module 10. The input data may be for example, equipment specification data of components (devices) configuring the compressor system 2, physical property data of gas flowing inside the compressor system 2, process condition data used in the simulation of compressor system 2, plant model related data and the like.

Display Unit

The display unit 13 (see FIG. 1) is, for example, a monitor terminal and displays the result calculated by the simulation unit 102 using a graph. The display unit 13 displays, for example, a setting screen of parameters, a simulation result of the simulation unit 102, time history data (trend graph) of the measured plant model, an operating point of the HQ map, a result of tuning a PID parameter etc.

Upper Level Module

The upper level module 10 is provided with a data storing unit 101, a simulation unit 102, a PID parameter adjusting unit 103, and a PID parameter setting unit 104.

Data Storing Unit

The data storing unit 101 stores equipment specification data of components (devices) that constitute the compressor system 2, physical property data of gas flowing inside the compressor 2, and process condition data for simulation using the plant model etc. Meanwhile, the equipment specification data, the physical property of gas, and process condition data and etc. are inputted to the control device 1 via the input unit 12 in advance. Further, every time the PID adjusting unit 103 adjusts a control parameter, the data storing unit 101 stores the simulation result and the adjusted parameter.

Further, it is possible to display process condition stored in the data storing unit 101 to the display unit 13, adjust the process condition data by operating the input unit 12, and store the adjusted result into the data storing unit 101.

The equipment specification data includes the specification data of the compressor 201, the specification data of the suction drum 204, the specification data of the suction throttle valve 205, the specification data of the anti-surge valve 206, the specification data of the pipes (suction side pipe 208, discharge side pipe 209, return pipe 210 etc.), the specification data of the heat exchanger 207, and the specification data of the drive motor 202.

The specification data of the compressor 201 includes, for example, HQ characteristics showing the relation between the suction flow rate and polytropic head, efficiency characteristics showing the relation between the suction flow rate and polytropic efficiency, the surge line showing the surge limit of the compressor 201 (see FIG. 2), the surge control line having a predetermined margin for the surge line (see FIG. 2), the inertia moment of rotating systems (the compressor 201, drive motor 202, transmission 203 etc.) and the like.

The specification data of the suction drum 204 includes the volume and designed exit temperature of the suction drum 204 etc.

The specification data of the suction throttle valve 205 and anti-surge valve 206 includes the inherent flow characteristics showing the relation between the opening degree of the valve and the flow rate, delay time from receiving a command signal to the actual operation start, full stroke operation time showing the necessary time from fully closed condition to fully opened condition, and a flow rate coefficient etc.

The specification data of the pipes (suction side pipe 208, discharge side pipe 209, return pipe 210 etc.) includes the pipe diameter, the pipe length and the like.

The specification data of the heat converter 207 includes the volume of the heat converter 207, the flow path resistance, the designed exit temperature, and the overall heat conduction function showing the characteristics of heat conduction, and the like.

The specification data of the drive motor 202 includes the torque characteristics represented by the relation between the rotational speed of the drive motor 202 and the torque; the rated rotational speed; the inertia moment of the rotating system configured to transmit driving force to the compressor 201 including the transmission 203, coupling (not shown), and shaft (not shown); and the speed reduction ratio or the speed increasing ratio of the transmission 203. The specification data of the drive motor 202 may further includes a time chart showing the rotational speed change of the drive motor 202 with time change.

The physical property data of gas flowing inside the pipe or the like of the compressor 2 includes the composition of the gas, average molecular weight, enthalpy data, compressibility factor data etc.

The process condition data for simulating the operation of the compressor 201 includes pipe arrangement (pipe structure showing the path of suction gas and discharge gas of the compressor 201 such as a branch or a confluence of the pipe), and arrangement of the anti-surge valve 206 (path length of the pipe from the suction port or the discharge port of the compressor 201 to the anti-surge valve 206, or the like). The process condition data may further include the structure of the compressor 201 (e.g. single compression stage, serial connection system, or parallel connection).

Simulation Unit

Figure 3:
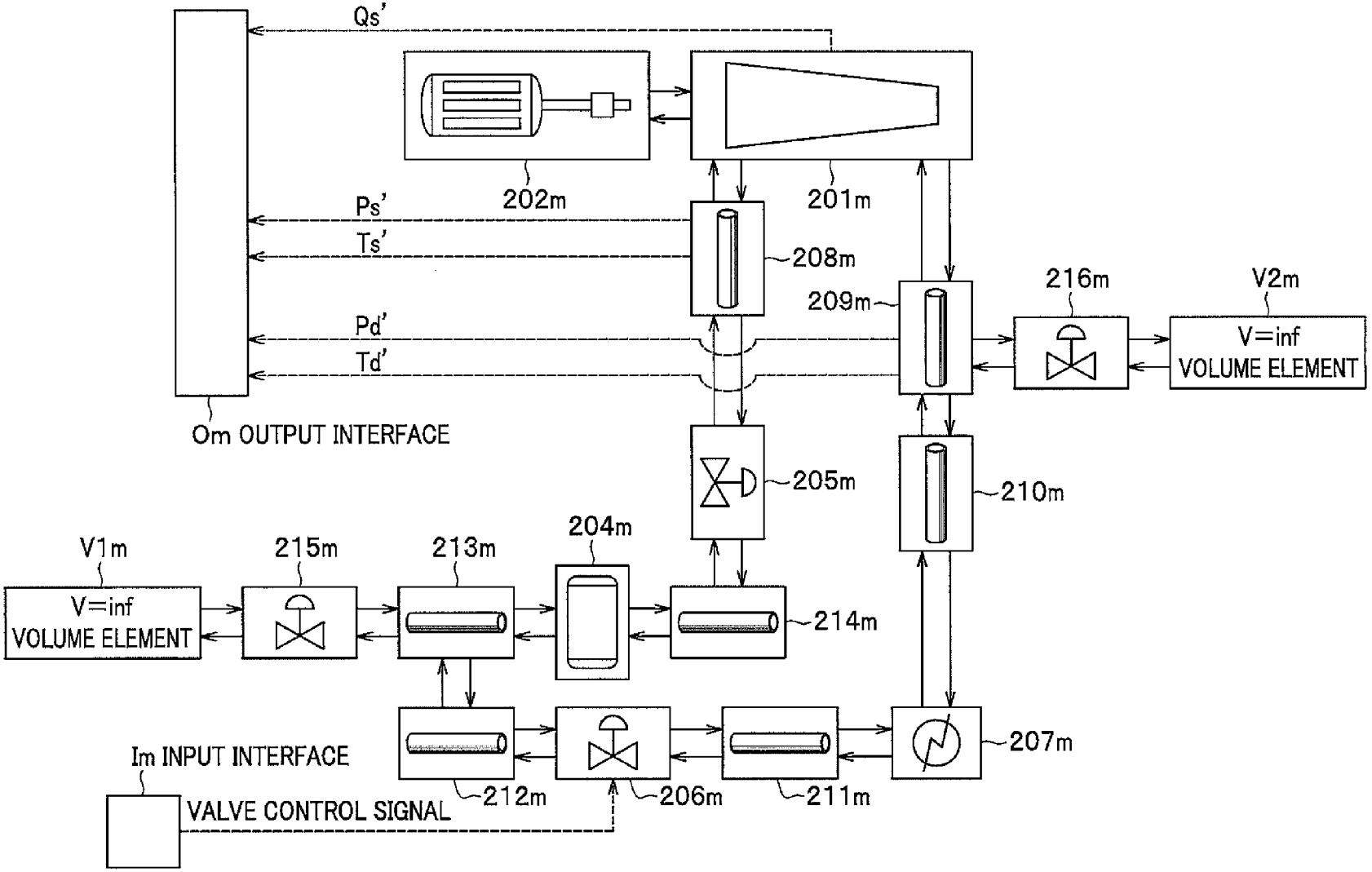
FIG. 3 is a block diagram schematically illustrating a configuration of a plant model used in the control device.

FIG. 3 is a block diagram schematically illustrating a configuration of the plant model used in the control device. In the simulation unit 102 (see FIG. 1), the unit model is implemented as operation programs corresponding to each component of the compressor system 2.

In FIG. 3, a solid line represents, for example, transmission of the quantity of state of the gas temperature or the like, and a dashed line represents transmission of the electrical signal of a control signal or the like.

The compressor unit model 201*m* which corresponds to the compressor 201 in FIG. 1 is represented by a polytropic head calculation formula shown with the formula (1), a suction flow rate calculation formula shown with the formula (2), a polytropic efficiency calculation formula shown with the formula (3), and a compressor load calculation formula shown with the formula (4).

$$h_{pol} = \frac{1}{g}\frac{n}{n-1}RT_s\left[\left(\frac{p_d}{p_s}\right)^{\frac{n-1}{n}} - 1\right] \quad \text{formula (1)}$$

where
$h_{pol}$: polytropic head [m],
g: gravitational acceleration [m/s$^2$],
n: polytropic index,
R: gas constant [J/kgK],
$T_s$: suction temperature [K],
$p_s$: suction pressure [Pa] and
$p_d$: discharge pressure [Pa].

$$Q_s(N) = \frac{N}{N_R} f_Q\left[h_{pol}\left(\frac{N_R}{N}\right)^2\right] \quad \text{formula (2)}$$

where
$Q_s$: suction flow rate [m$^3$/h],
N: rotational speed [rpm],
$N_R$: rated rotational speed [rpm] and
$f_Q$: suction flow rate; polytropic head performance curve represented by polytropic head.

$$\eta_{pol}(N) = f_\eta\left[Q_s(N)\frac{N_R}{N}\right] \quad \text{formula (3)}$$

where
$n_{pol}$: polytropic efficiency and
$f_n$; suction flow rate; polytropic head performance curve represented by suction flow rate.

$$L_c = \frac{\dot{m}_s g h_{pol}}{1000\eta_{pol}} \quad \text{formula (4)}$$

where
$L_C$: compressor shaft power [kW],
g: gravitational acceleration [m/s$^2$] and
$\dot{m}_s$; compressor suction mass flow rate [kg/s].

The suction throttle valve unit model 205*m* which corresponds to the suction throttle valve 205 in FIG. 1 and the anti-surge valve unit model 206*m* which corresponds to the anti-surge valve 206 in FIG. 1 are represented by a flow rate calculation formula shown with the formula (5).

$$\dot{m} = C_V\sqrt{2\beta|p_s - p_d|} \quad \text{formula (5)}$$

where
$\dot{m}$: mass flow rate [kg/s],
$C_V$: flow rate coefficient,
ρ: density [kg/m$^3$],
$p_s$: suction pressure [Pa] and
$p_d$: discharge pressure [Pa].

Pipe unit models (208*m*, 209*m*, 210*m* etc.) are configured by modeling the nonstationary state of the gas flowing inside the pipes (208, 209, 210 etc.) arranged around the compressor 201 shown in FIG. 1. The pipe unit models are represented by a mass balance formula shown with the formula (6) and an energy balance formula shown with the formula (7).

In addition, the suction drum unit model 204*m* corresponding to the suction drum shown in FIG. 1 is also represented by the formula (6) and the formula (7).

$$\frac{dp}{dt} = \frac{p}{T}\frac{dT}{dt} + \frac{p}{\rho V}(\dot{m}_s - \dot{m}_d) \quad \text{formula (6)}$$

where
p: pressure [Pa],
t: time [s],
T: temperature [K],
μ: density [kg/m$^3$],
V: volume [m$^3$],
$\dot{m}_s$: inflow [kg/s] and
$\dot{m}_d$: outflow [kg/s].

$$\frac{dh}{dt} = \frac{1}{\rho V}(\dot{m}_s h_s - \dot{m}_d h_d) \quad \text{formula (7)}$$

where
h: enthalpy [J/kg],
$h_s$: inflow enthalpy [J/kg] and
$h_d$: outflow enthalpy [J/kg].

Note that, in the case where a plurality of pipes are connected, node element unit models (not shown) are inserted between the pipes. The node element unit model is represented by a flow rate calculation formula shown with the formula (8).

$$\dot{m}=A\sqrt{2\rho|p_s-p_d|} \quad \text{formula (8)}$$

where

A: flow path cross-section area [$m^2$].

A heat converter unit model 207*m* which corresponds to the heat converter 207 is represented by a heat quantity calculation formula shown with the formula (9).

$$Q=KA_c\Delta T \quad \text{formula (9)}$$

where

Q: heat transfer rate [W],

K: coefficient of heat transfer [$W/m^2K$], $A_c$: heat transfer area [$m^2$] and ΔT: difference in temperature [K].

The drive motor unit model 202*m* which corresponds to the drive motor 202 is represented by a torque balance formula shown with the formula (10).

$$J\frac{d\omega}{dt}=T_M-\frac{L_c}{\omega} \quad \text{formula (10)}$$

where

J: inertia moment [$kgm^2$],

ω: angular velocity [rad/s], $T_M$: motor torque [Mn] and $L_c$: compressor shaft torque [Nm].

Here, processes upstream of the pipe 213 shown in FIG. 1 are simulated by a volume element model V1*m* having infinite volume. Similarly, processes downstream of the pipe 209 shown in FIG. 1 are simulated by a volume element model V2*m* having infinite volume. In addition, a suction side slice valve unit model 215*m* is provided, then using the opening degree thereof as a parameter, the flow rate of gas flowing into the pipe 213 of the compressor system 2 is simulated. Similarly, a discharge side slice valve unit model 216*m* is provided, then using the opening degree thereof as a parameter, the flow rate of gas discharged from the pipe 209 of the compressor system 2 is simulated.

In addition, the plant model is provided with an interface that transmits and receives signals with the valve control unit 11. The interface includes an output interface Om that outputs a process signal calculated by the simulation unit 102 to the valve control unit 11, and an input interface Im that inputs a control signal from the valve control unit 11 to the anti-surge valve unit model 206*m*.

The simulation unit 102 outputs to the valve control unit 11 (see FIG. 1) of the compressor system 2, via the output interface Om, process signals (the suction flow rate $Q_s'$ of the compressor unit model 201*m*, the suction pressure $P_s'$ and the suction temperature $T_s'$ of the gas flowing inside the suction side pipe unit model 208*m*, the discharge pressure $P_d'$ and the discharge temperature $T_d'$ of the gas flowing inside the discharge side pipe unit model 209*m*).

Here, each of the process signals is calculated on the basis of the formulas (1) to (10) and simulation conditions of the plant model. In addition, in the description of the process signals, the suction flow rate of the compressor unit model 201*m* is shown as "$Q_s'$" for example, and the suction flow rate of the actual compressor 201 (see FIG. 1) of the compressor system 2 is shown as "$Q_s$", by which they are distinguished to each other. This distinguishing manner is similarly used in the following descriptions including other process signals.

The valve control unit 11 (see FIG. 1) performs the PID control on the basis of the process signals, and inputs the valve control signal to the anti-surge valve unit model 206*m* via the input interface Im. In other words, the simulation unit 102 adjusts the opening degree of the anti-surge valve unit model 206*m* in accordance with the valve control signal outputted from the valve control unit 11.

The function of the simulation unit 102 includes the process of combining device unit models such as pipe unit models in accordance with the configuration of the compressor system 2 which is to be simulated. More specifically, each unit model represented by a subroutine program is configured on the main program in accordance with the configuration of the compressor system 2 which is to be simulated.

The simulation unit 102 simulates the behavior of the compressor system 2 by modeling the physical system and control system of each device constituting the compressor system 2.

The simulation unit 102 calculates the operational status of the plant model of the target system in accordance with the condition data inputted from the input unit 12. For example, when simulating start-up of the compressor system 2 for example, the simulation unit 102 calculates the non-steady operational status of the drive motor unit model 202*m* from the motionless state with the rotational speed 0 rpm until reaching the state with the rated rotational speed.

PID Parameter Adjusting Unit

The PID parameter adjusting unit 103 (see FIG. 1) adjusts the PID parameter of the valve control unit 11 on the basis of the simulation result performed by the simulation unit 102. The adjustment method of the PID parameter is, for example, based on the limit sensitivity method or transient response method but not limited thereto.

The details of the PID adjustment method will be explained later. In addition, in this embodiment, it is assumed that the valve control signal from the control device 1 (see FIG. 1) is outputted to the upper level module 10 and the actual compressor system 2 is not in operation when auto-tuning of the PID parameter is in execution.

PID Parameter Setting Unit

The PID parameter setting unit 104 (see FIG. 1), when the adjustment of the PID parameter is completed, transmits the adjusted PID parameter to the valve control unit 11 of the actual compressor system 2 via communication means, and set the parameter as a new PID parameter to be used by the valve control unit 11.

Meanwhile, the setting of the PID parameter to the valve control unit 11 may be triggered by specified operation via the input unit 12 by a user after checking the simulation result and the PID parameter displayed on the display unit 13.

Further, the user may appropriately adjust the PID parameter via the input unit 12 on the basis of the simulation result displayed on the display unit 13. In such a case, the PID parameter setting unit 104 transmits the adjusted PID parameter via communication means to the valve control unit 11.

In addition, for example, it may be possible to adjust the PID parameter of the valve control unit 11 while temporarily suspending the compressor system 201, and restart the valve control unit 11 in accordance with the adjusted PID parameter. In such a case, it is possible for the user to switch the control target of the valve control unit 11 from the actual compressor system 2 (see FIG. 1) to the plant model (see FIG. 3) for entering into the mode of adjusting the PID parameter.

Further, when adjusting the PID parameter has been completed, it is possible for the user to switch the control target of the valve control unit 11 from the plant model (see FIG. 3) to the actual compressor system 2.

In other words, the valve control unit 11 is provided with a switching means that switches the control target.

PID Tuning

Figure 4:
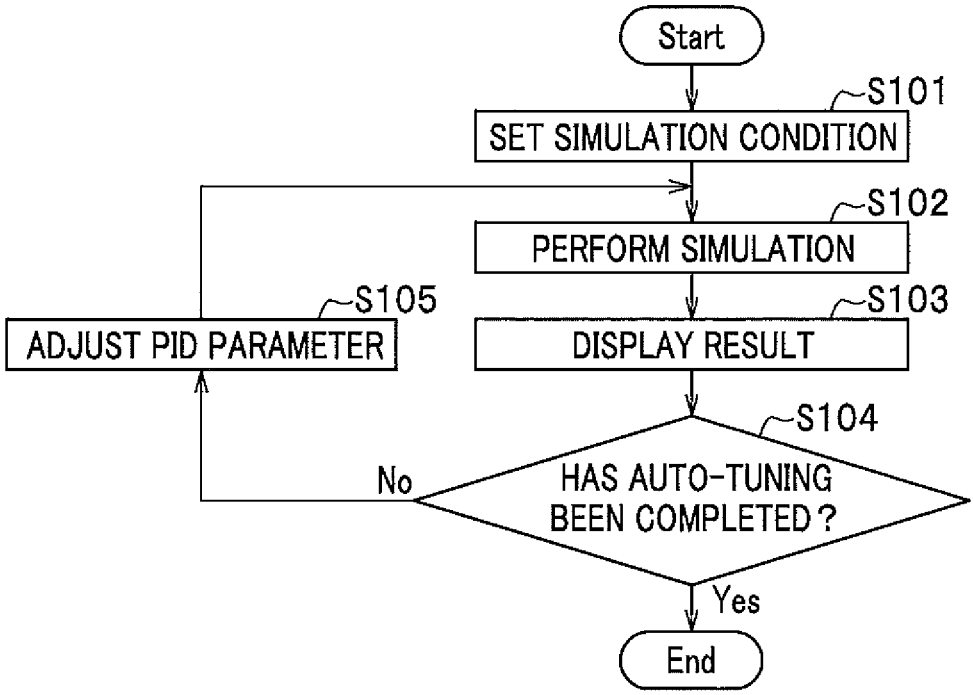
FIG. 4 is a flow chart showing a flow of tuning a PID parameter using the control device.

FIG. 4 is a flow chart showing a flow of tuning a PID parameter using the control device. Hereinafter, a preliminary tuning of the PID parameter of the valve control unit 11 using a simulation on start-up of the compressor unit model 201*m* will be explained.

Normally, a plant model used by the simulation unit 102 of the compressor system 2 is preset during the manufacturing process of the control device 1. More specifically, the plant model is described as a computer program to be executed by the simulation unit 102 in accordance with the configuration of the compressor system 2 during the manufacturing process.

Normally, the design data of the compressor system 2 is inputted into the data storing unit 101 in advance during the manufacturing process of the control device 1. As explained previously, the inputted data usually includes the equipment specification data of components (devices) configuring the compressor system 2, physical property data of gas flowing inside the compressor system 2, process condition data used in the simulation of compressor system 2, plant model related data and the like.

However, in a case when the configuration or the operating condition of the compressor system 2 is to be changed, it is possible for the user to change, via the input unit 12, the computer program of the simulation unit 102 of the compressor system 2 or design data stored in the data storing unit 101.

At a step S101 in FIG. 4, the user sets the simulation conditions. More specifically, the user sets, via the input unit 12, initial conditions of the compressor system 2, external conditions, simulation time, initial value of the PID parameter in the valve control unit 11 and the like. The initial conditions may be, for example, the pressure and temperature of gas at the start-up of the compressor 201 or the like. The simulation time may be set to 60 seconds for example. The initial values of the PID parameters are: the gain of the proportional element $G_p=1$, the gain of the integral element $G_I=0$, the gain of the differentiating element $G_D=0$ in a case where the later mentioned limit sensitivity method is used.

At a step S102, the simulation unit 102 performs the simulation on the basis of the simulation conditions, and simulates the flow condition of gas in the compressor system 2 etc.

More specifically, the simulation unit 102 calculates each of the physical quantities in accordance with the relations between devices shown in FIG. 3 etc. on the basis of the formulas (1) to (19). In addition, the valve control unit 11 performs the PID control calculation on the basis of the process signals ($Q_s'$, $P_s'$, $T_s'$, $P_d'$, $T_d'$) outputted from the plant model, and outputs the valve control signal to the anti-surge valve unit model 206*m* via the input interface Im. The simulation unit 102 adjusts the opening degree of the anti-surge valve unit model 206*m* in accordance with the valve control signal outputted from the valve control unit 11.

Figure 5:
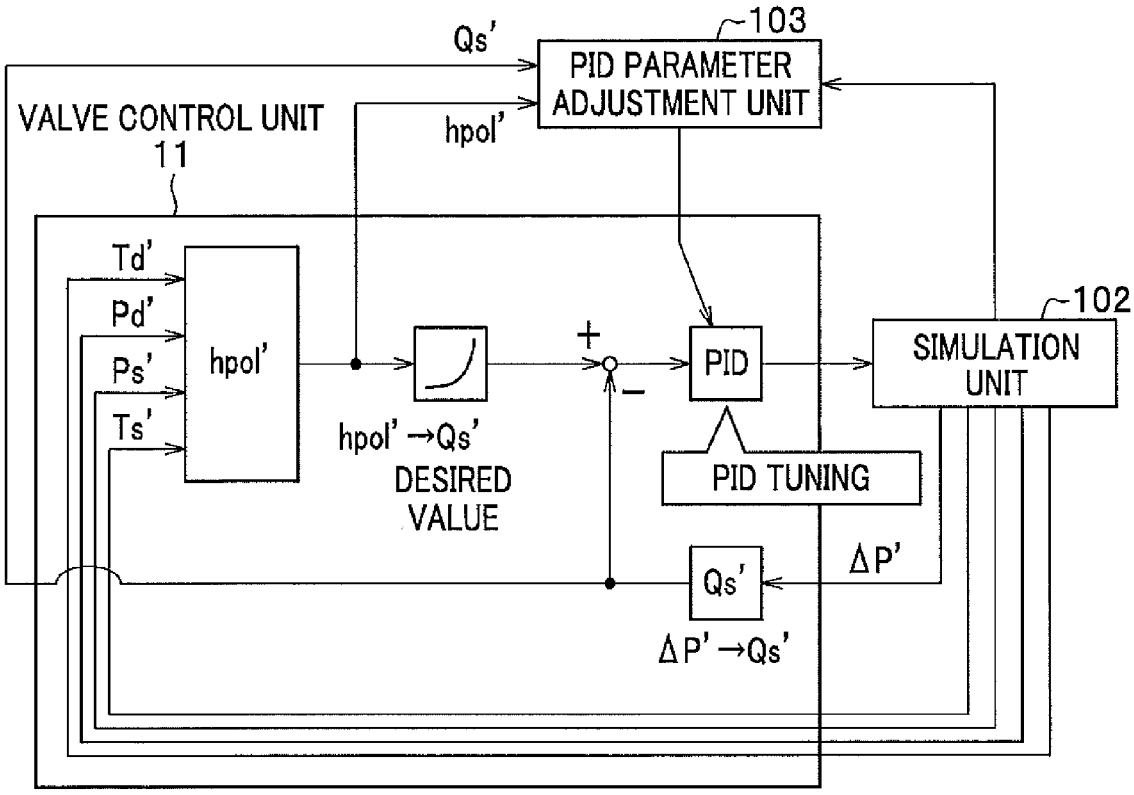
FIG. 5 is a functional diagram of tuning a PID parameter using the control device.

FIG. 5 is a functional diagram of tuning PID a parameter using the control device. As shown in FIG. 5, when the simulation is in execution, the process signals (suction flow rate $Q_s'$, suction pressure $P_s'$, suction temperature $T_s'$, discharge pressure $P_d'$, and discharge temperature $T_d'$), which have been calculated by the simulation unit 102 of the upper level module 10, are inputted to the valve control unit 11. Note that, the suction flow rate $Q_s'$ is calculated from a differential pressure $\Delta P'$ measured by a unit model (not shown) corresponding to an Orifice or a Venturi tube.

The valve control unit 11 calculates a polytropic head $h_{pol}'$ using the inputted process signal, performs the closed-loop operation of the PID control considering the surge control line (see FIG. 2) as a desired value $Q_s'$, and generates a valve control signal. The closed-loop operation of the PID control is performed in a similar manner to the case where the valve control unit 11 controls the anti-surge valve 206 arranged in the compressor system 2.

Further, the valve control unit 11 generates a valve control signal which is the calculation result of the PID control, and the opening degree of the anti-surge valve unit model 206*m* (see FIG. 3) is adjusted in accordance with the valve control signal.

Consequently, the flow rate, the pressure and the temperature, which are calculated by each of the unit models (208*m*, 209*m*, 210*m* etc.), are changed. At the same time, the operating point of the HQ map calculated by the compressor unit model 201*m* is changed.

Returning to the step S103 in FIG. 4, the upper level module 10 displays on the display unit 13 the simulation result and the PID parameter used therein. The simulation result displayed on the display unit 13 may includes, for example, the time change of the rotational speed of the rotor, the torque speed curve, the time change of the suction pressure and discharge pressure, the time change of the suction temperature and discharge temperature, the operating point record of the HQ map of the compressor, the time change of the valve opening degree of the anti-surge valve unit model 206*m* etc.

Every time the PID parameter adjusting unit 103 adjusts the PID parameter, the simulation result thereof is saved in the data storing unit 101, and the upper level module 10 reads out the characteristics from the data storing unit 101 and displays it on the display unit 13. In addition, the upper level module 10 displays on the display unit 13 the process condition data (the pressure, the temperature, and the like of the gas on start-up) as a simulation result when the time=0.

Further, the user can select data to be displayed on the display unit 13 via the input unit 12. For example, the user may select via the input unit 12, the operating point record of the HQ map of the compressor, the time change of the suction flow rate of the compressor, and the time change of the valve opening degree of the anti-surge valve unit model 206*m* to be displayed on the display unit 13.

At a step S104 in FIG. 4, the upper level module 10 determines whether or not the auto-tuning of the PID parameter has been completed. The criteria of the determination whether or not the auto-tuning has been completed varies with the tuning method. At the step S104, in a case when the auto-tuning of the PID parameter has not been completed ("No" at the step S104), the step proceeds to a step S105. At the step S105, the PID parameter adjusting unit 103 adjusts the PID parameter of the valve control unit 11. In contrast, at the step S104, in a case when the auto-tuning of the PID parameter has been completed ("Yes" at the step S104), the tuning process is terminated.

The tuning method of the PID parameter is based on the limit sensitivity method or transient response method but not limited thereto. In this embodiment, the explanation will be made about a case where the PID parameter is adjusted on the basis of the limit sensitivity method.

First, the control by the valve control unit 11 is assumed to be a proportional control. More specifically, the initial values of the PID parameters are set to: $G_P=1$, $G_I=0$ and $G_D=0$.

Here, the initial values of the PID parameters are inputted by the user at the step S101 when setting the simulation conditions. The simulation result by the simulation unit 102 according to the conditions is shown in FIGS. 6A to 6C.

Figure 6A:
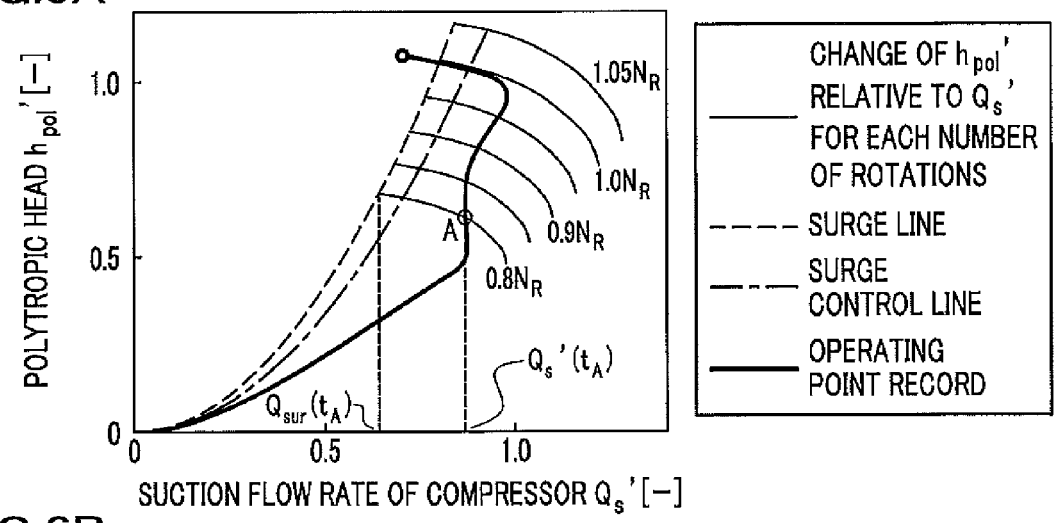
FIGS. 6A to 6C are explanatory diagrams of characteristics in tuning a PID parameter using the control device where $G_P=1$, $G_I=0$, and $G_D=0$.

FIG. 6A is a diagram with a compressor suction flow rate $Q_S'$ shown in the horizontal axis made dimensionless, and a polytropic head $h_{pol}'$ shown in the vertical axis made dimensionless in the similar manner to FIG. 2. In addition, a plurality of oblique thin solid lines in FIG. 2 represent $h_{pol}'$ corresponding to each of the rotational speeds. For example, rotational speeds multiplied by 0.8 to 1.05 to the rated rotational speed $N_R$ are shown. Other lines are shown in the same way as FIG. 2. In FIG. 6A, at time tA, the compressor system reaches the operating point A having the rotational speed $0.8N_R$ for example. At that point, the compressor suction flow rate is $Q_s'(t_A)$, and the surge flow rate $Q_{sur}$ is $Q_{sur}(t_A)$ respectively.

Figure 6B:
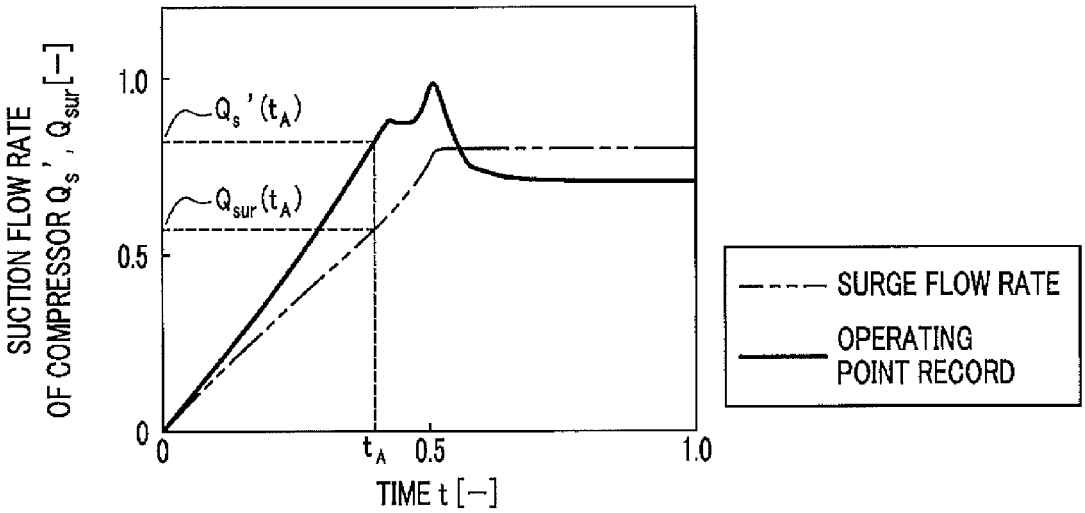
Figure 6C:
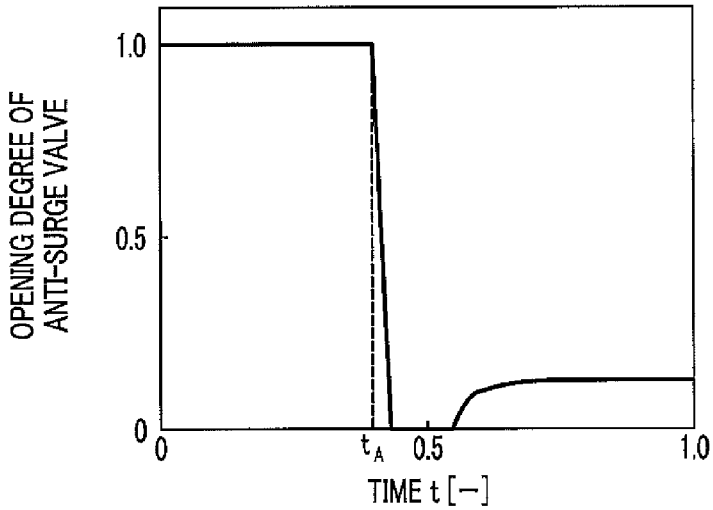

FIG. 6B shows the time change of the compressor suction flow rate $Q_s'$ and the surge flow rate $Q_{sur}$. The horizontal axis shows time t which is made dimensionless by making the maximum simulation time as 1.0, and the vertical axis shows the compressor suction flow rate $Q_s'$ which is made dimensionless in the same manner as FIG. 6A. The compressor suction flow rate $Q_s'(t_A)$ and the surge flow rate $Q_{sur}(t_A)$ at time $t_A$ that has been shown in FIG. 6A are shown in FIG. 6B. In FIG. 6B, the compressor suction flow rate $Q_s'(t_A)$ and the surge flow rate $Q_{sur}(t_A)$ at time t corresponding to the operating point record shown in FIG. 6A are shown as well. FIG. 6C shows the opening degree of the anti-surge valve corresponding to the simulation time t. The horizontal axis shows time t which is made dimensionless in the same manner as FIG. 6B and the vertical axis shows the valve opening degree with the full opening condition as 1.0. FIG. 6C shows that the adjustment of the anti-surge valve opening degree starts to adjust the suction flow rate by the compressor at time to when the rotational speed has reached 0.8NR.

Figure 7A:
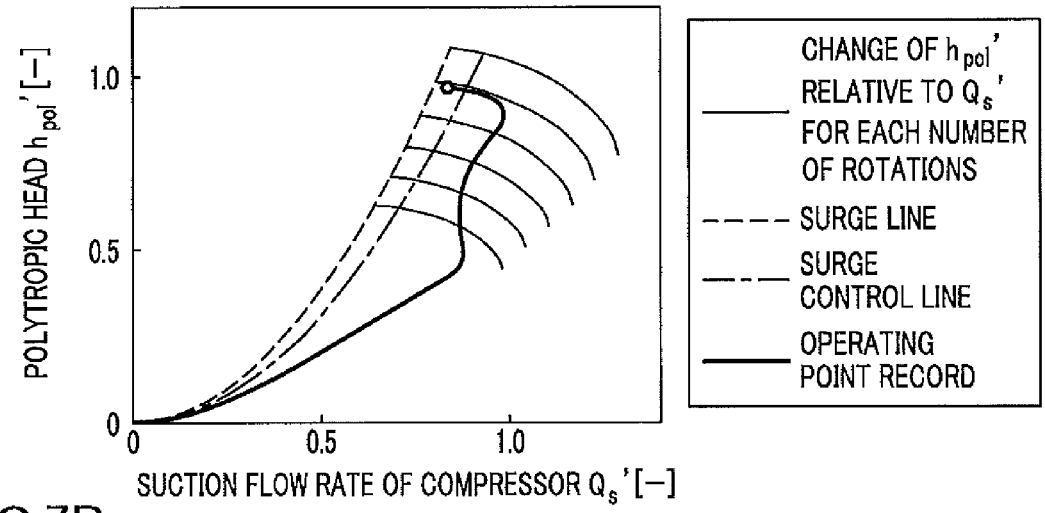
FIGS. 7A to 7C are explanatory diagrams of characteristics in tuning a PID parameter using the control device where $G_P$=20, $G_I$=0, and $G_D$=0.

Meanwhile, the explanation for FIGS. 7 and 8 will be omitted since they are same as that of FIG. 6.

Referring to FIG. 6A, it can be found that there is an operating point that falls into the surge region in the HQ characteristics of the compressor unit model 201*m*. In addition, referring to FIG. 6B, it can be found that the suction flow rate of the compressor unit model 201*m* is lower than the surge flow rate after the point where time t is approximately 0.6. In other words, the possibility of surge is high due to the suction flow rate being too low.

Next, the simulation is repeated with gradually increasing the gain Gp of the proportional element, and increasing the gain is paused when the output is stabilized with a vibration with a specific amplitude (This point is regarded as a stability limit and at this point the value of $G_P$ is specified as $K_c$ and the value of the vibrating period as $T_c$).

Figure 7B:
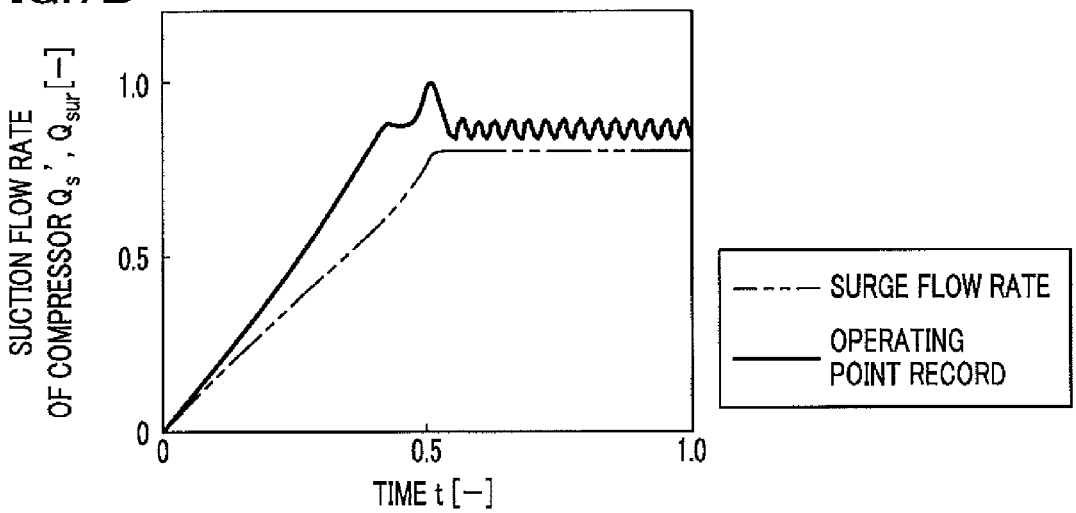
Figure 7C:
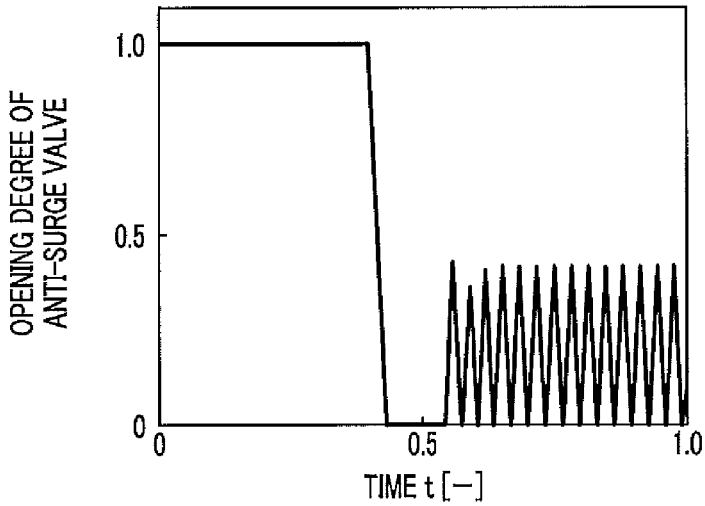

FIG. 7 shows various characteristics in a case when the opening degree response of the anti-surge valve unit model 206*m* has reached the vibration state. In this case, the suction flow rate $Q_s'$ of the compressor unit model 201*m* becomes vibrational (see FIG. 7B) in responsive to the opening degree of the anti-surge valve unit model 206*m* becoming vibrational (see FIG. 7C).

The PID parameter adjusting unit 103 adjusts the PID parameter on the basis of the table 1 using $K_c$ the value of $G_P$ at the stability limit and the vibrating period $T_c$ at the stability limit. In FIG. 8 for example, if $K_c$=20 and $T_c$=2, then PID parameters are set as $G_P$=11.8, $G_I$=1.0, and $G_D$=0.25 when performing the PID control.

Meanwhile, when performing a PI control, the parameters are set as $G_P$=9.0, and $G_I$=1.66 in accordance with the table 1, or when performing a P control, the parameters is set as $G_P$=10.0 in accordance with the table 1.

TABLE 1

| Control mode | Proportional gain $G_P$ | Integral gain $G_I$ | Differential gain $G_P$ |
|---|---|---|---|
| P | 0.5 $K_C$ | — | — |
| PI | 0.45 $K_C$ | 0.83 $T_C$ | — |
| PID | 0.59 $K_C$ | 0.5 $T_C$ | 0.125 $T_C$ |

Figure 8A:
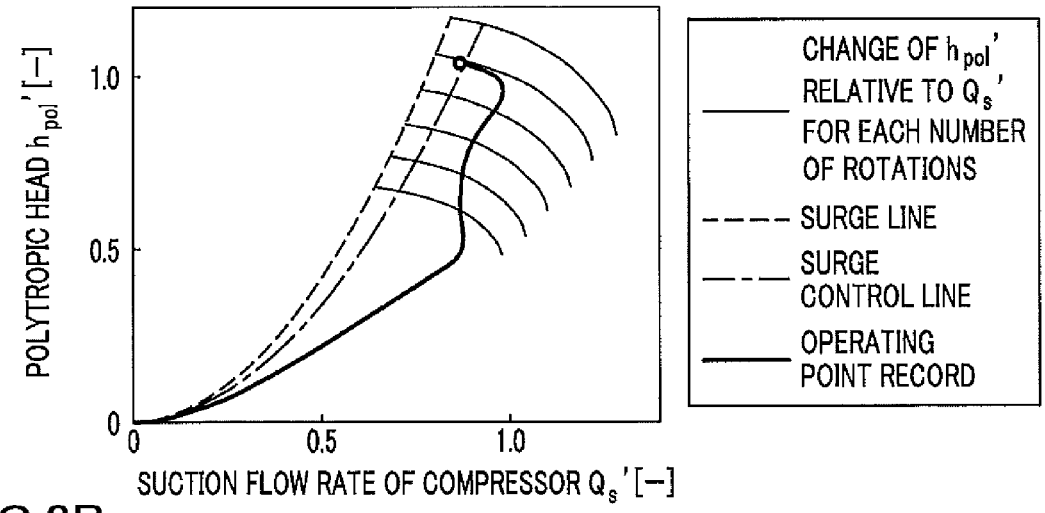
FIGS. 8A to 8C are explanatory diagrams of characteristics in tuning a PID parameter using the control device where $G_P$=11.8, $G_I$=1.0, and $G_D$=0.25.
Figure 8B:
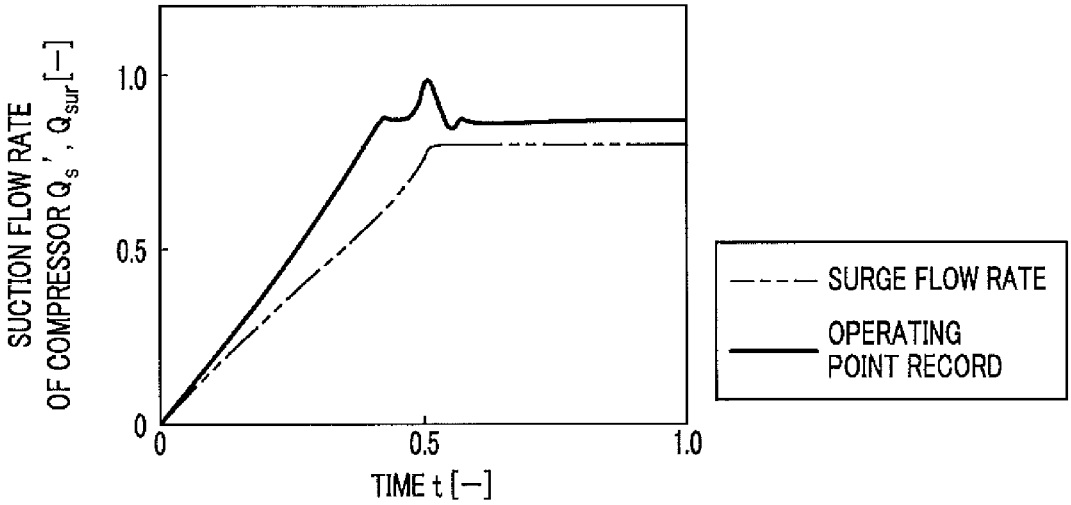
Figure 8C:
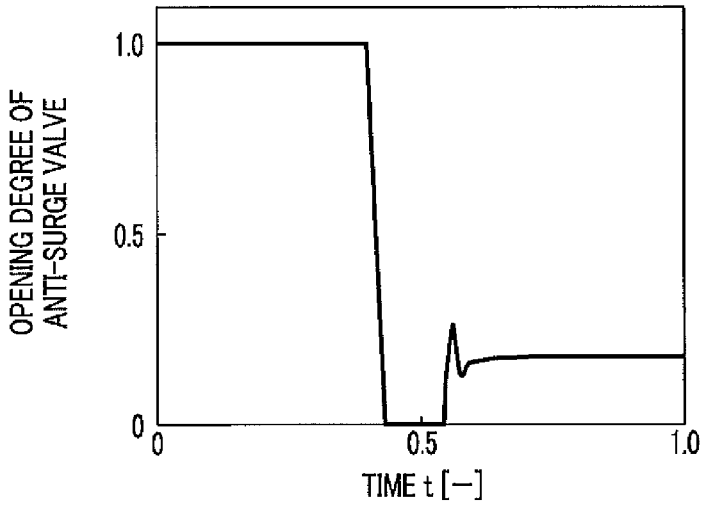

The simulation unit 102 further performs the simulation on the basis of the PID parameters adjusted by the PID parameter adjusting unit 103. FIGS. 8A to 8C show the various characteristics when the simulation has been performed using the parameters ($G_P$=11.8, $G_I$=1.0, and $G_D$=0.25) adjusted by the PID parameter adjusting unit 103.

Referring to FIG. 8A, it can be found that the operating point in the HQ characteristics of the compressor unit model 201*m* is within the operative region which is right side of the surge control line. Referring to FIG. 8B, it can be found that the suction flow rate of the compressor unit model 206*m* is higher than the surge flow rate. That is, it is ensured that the suction flow rate is high enough.

Accordingly, it is expected that the compressor 201 can perform the stable control without causing surge when controlling the actual compressor system 2 with the valve control unit 11 using parameters having the characteristics shown in FIG. 8 ($G_P$=11.8, $G_I$=1.0, and $G_D$=0.25).

In this embodiment, the control device 1 is provided with a plant model, and auto-tuning of the PID parameters has been performed on the basis of the limit sensitivity method or the like using the simulation result of the plant model. According to the control device 1 of the embodiment, it is possible to perform a preliminary tuning of the control system using a plant model in advance to the actual field test. In addition, a risk of surge in the compressor system 2 can be eliminated during the adjustment stage since it is possible to adjust the PID parameters of the control device 1 without operating the actual compressor 201 etc. of the compressor system 2. Further, it is possible to substantially reduce time required for the adjustment since the effort can be saved compared to a case where the PID parameters are adjusted by the try-and-error method.

In this embodiment, although preliminary tuning of the PID parameters for the start-up of the compressor 201 has been explained, the invention can also be applied to other cases when stopping the compressor 201 or re-staring the compressor 201 after being stopped.

In addition, in the embodiment, although the valve control unit 11 is configured to perform the PID control using the process signals outputted by the plant model and outputs the control signal to the anti-surge valve unit model 206*m* of the plant model, the following configuration may also be possible. That is, the plant model of the simulation unit 102 may be configured to further include a unit model of the valve control unit that corresponds to the valve control unit 11, and perform the PID control in accordance with the unit model of the valve control unit. In this case, the PID parameter setting unit 104 transmits the adjusted PID parameters to the valve control unit 11 via communication means.

Further, in this embodiment, although auto-tuning of the PID parameters has been explained, the user may manually perform the tuning by changing the PID parameter of the valve control unit 11 and checking the calculation result of the simulation result. In this case, the user can change the PID parameters at the user's choice via the input unit 12 while checking behavior such as the operating point of the compressor unit model 201*m* via the display unit 13.

Second Embodiment

Next, will be explained a control device 1A of the compressor according to the second embodiment of the present invention.

The control device 1A according to the second embodiment performs model tuning on the basis of the valve control signal outputted by the valve control unit 11 so that the operating point ($Q_s'$, $h_{pol}'$) calculated by the upper level module 10A becomes closer to the actual operating point ($Q_s$, $h_{pol}$) of the compressor system 2.

Figure 9:
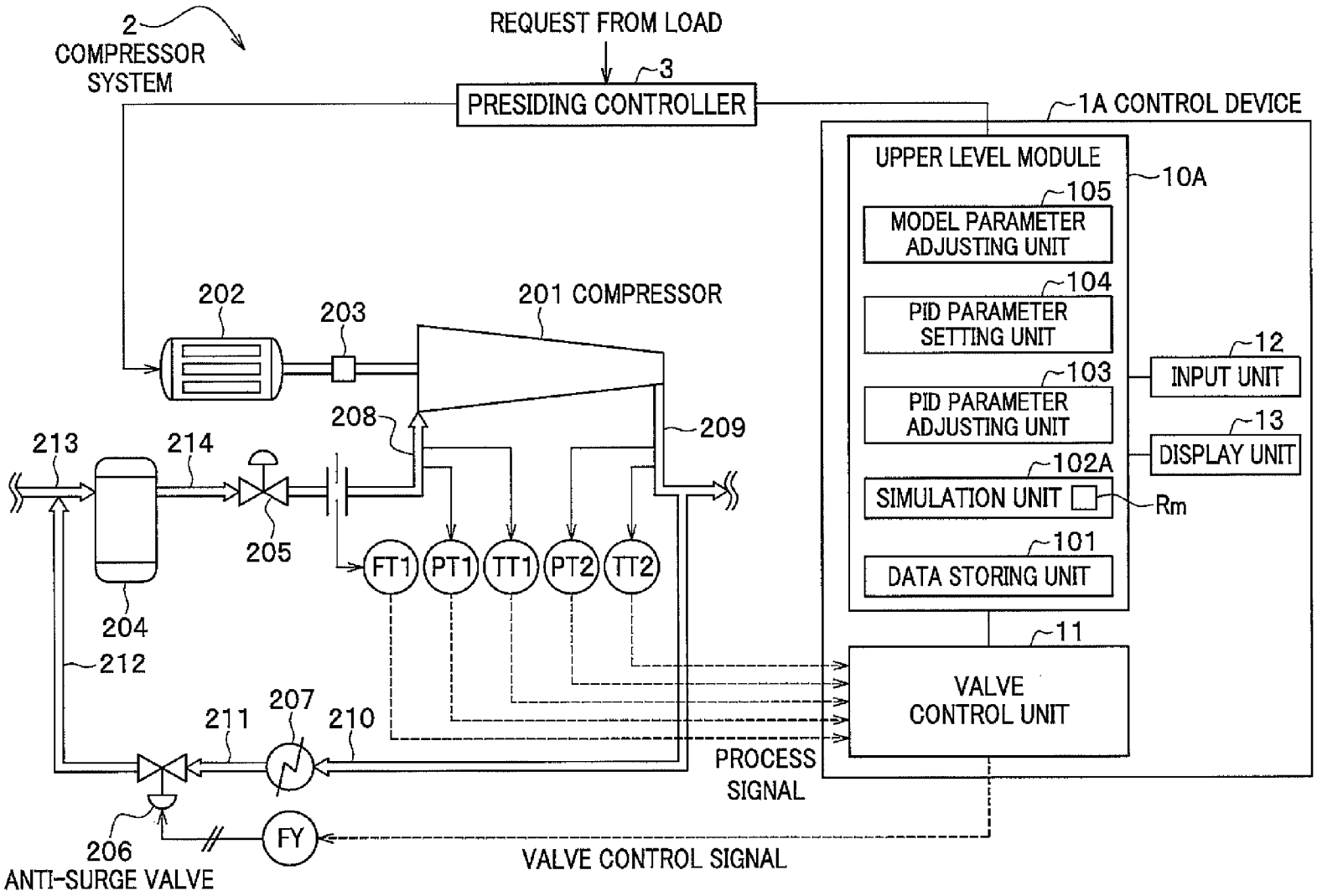
FIG. 9 is a block diagram of a compressor system including a control device of a compressor according to the second embodiment of the invention.

FIG. 9 is a block diagram of a compressor system including a control device of a compressor according to the second embodiment of the invention. Comparing the control device 1A of this embodiment with that of the first embodiment, a model parameter adjusting unit 105 is added to the upper level module 10A. In addition, the simulation unit 102A is provided with an open-loop model Rm.

Meanwhile, since other components are same as those of the first embodiment, same symbols are used for the same components and the redundant explanations will be omitted.

As shown in FIG. 9, when the compressor system 2 is in operation, the valve control unit 11 regularly acquires the process signals (suction flow rate $Q_s$, suction pressure $P_s$, suction temperature $T_s$, discharge pressure $P_d$, and discharge temperature $T_d$), calculates the PID parameters, and outputs the valve control signal to the anti-surge valve 206.

The user can select via the input unit 12 whether or not to perform the model tuning.

In a case when performing the model tuning, the valve control signal which is outputted from the valve control unit 11 to the anti-surge valve 206 is also outputted to the open-loop model Rm of the upper level module 10A. In addition, the valve control unit 11 outputs, to the model parameter adjusting unit 105, the operating point ($Q_s$, $h_{pol}$) calculated from the process signals detected corresponding to the valve control signal.

The simulation unit 102A is provided with the open-loop model Rm which takes in the valve control signal from the valve control unit 11 and outputs the operating point ($Q_s'$, $h_{pol}'$) calculated on the basis of the valve control signal.

The model parameter adjusting unit 105 adjusts and updates the model parameter of the open-loop model Rm with respect to the operating point ($Q_s$, $h_{pol}$) outputted from the valve control unit 11 so that the absolute value of the error between the operating point ($Q_s'$, $h_{pol}'$) calculated using the open-loop model is lower than a predetermined threshold.

Thus, the model parameters are sequentially updated and when the absolute value of the error has become lower than or equal to a predetermined value, it is deemed that the open-loop model Rm has successfully produced the behavior of the actual compressor system 2 using the model parameters.

Figure 10:
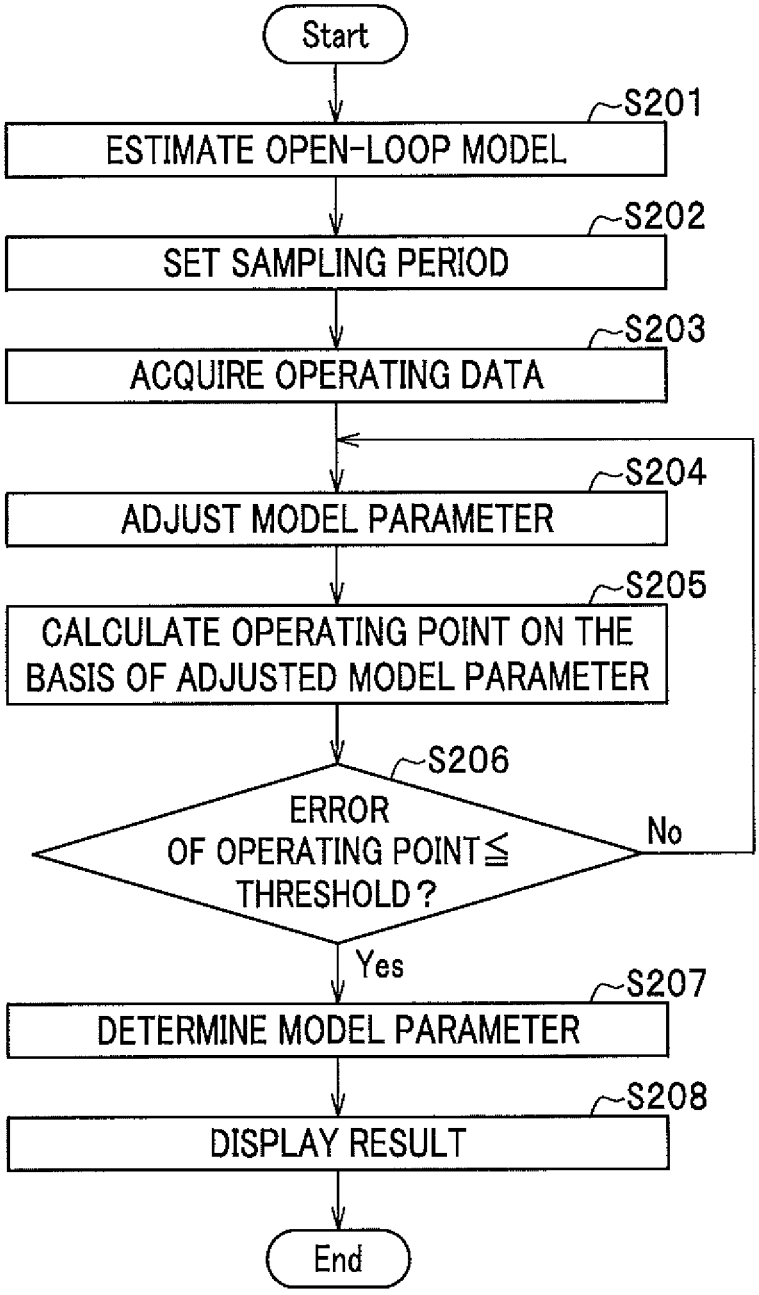
FIG. 10 is a flow chart showing a flow of tuning a model parameter using the control device.

FIG. 10 is a flow chart showing the flow of tuning a model parameter using the control device.

At a step S201, the model parameter adjusting unit 105 estimates the open-loop model Rm which outputs the suction flow rate $Q_s'$ on the basis of the calculation performed by the simulation unit 102A when the valve control signal is inputted from the valve control unit 11. The open-loop model Rm may be, for example, an ARX model but not limited thereto. In addition, the open-loop model Rm may be derived directly from the formulas (1) to (10) which represent each of the elements (see FIG. 3) constituting the plant model, or may be derived by a simulation experiment using a transient response method or a frequency response method. Hereinafter, will be explained a case where an ARX model is used.

The ARX model is represented by the following formula (11).

In this embodiment, the input data u(k) is a valve control signal outputted from the valve control unit 11. In addition, the output data y(k) is the suction flow rate $Q_s'$ of the compressor unit model 201*m*. Further, k is a number which is given when acquiring input and output sample data in accordance with the sampling period.

$$A(q)y(k)=B(q)u(k)+e(k) \quad \text{formula (11)}$$

where u(k): k-th input data, y(k): k-th output data and e(k): formula error contained in output value.

Here, A(q) and B(q) in the formula (11) are a polynomial expressed by the following formulas (12) and (13). The orders na and nb may be predetermined by the user via the input unit 12. Further, The coefficients ($a_1, \ldots, a_{na}$) and ($b_1, \ldots, b_{nb}$) of the formulas (12) and (13) may be estimated using the least-square method.

$$A(q)=1+a_1q^{-1}+\ldots+a_{na}q^{-na} \quad \text{formula (12)}$$

$$B(q)=b_1+b_2q^{-1}+\ldots+b_{nb}q^{-nb+1} \quad \text{formula (13)}$$

where na, nb: order.

At the step S202 in FIG. 10, a sampling period when acquiring the operating data (the valve control signal and operating point ($Q_s$, $h_{pol}$)) is set. The sampling period (0.2 seconds for example) may be set by the user via the input unit 12.

The sampling period thus set is outputted to the valve control unit 11 via communication means.

At a step S203, the model parameter adjusting unit 105 acquires a valve control signal as operating data from the valve control unit 11 in accordance with the sampling period. In other words, the model parameter adjusting unit 105 acquires a valve control signal outputted from the valve control unit 11 as the input data u(k) to the formula (11). Further, the model parameter adjusting unit 105 acquires the suction flow rate $Q_s$ of the compressor 2 from the valve control unit 11 as the output data y(k) of the formula (11).

At a step S204, the model parameter adjusting unit 105 adjusts the model parameters ($a_1, \ldots, a_{na}$) and ($b_1, \ldots, b_{nb}$) of the formulas (12) and (13) on the basis of the input-output data u(k) and y(k) obtained at the step S204. The adjustment may be performed using the least-square method to the ARX model.

Meanwhile, the model parameter adjusting unit 105 may perform, as preprocessing of the step S204, filtering or the like of the input-output data obtained from the valve control unit 11. In this case, the model parameter adjusting unit 105 performs specifying the effective range of the input-output data, removing trend, DC component, and unusual data etc.

At a step S205, the simulation unit 102A calculates the operating point ($Q_s'$, $h_{pol}'$) using the formulas (11) to (13) on the basis of the model parameters ($a_1, \ldots, a_{na}$) and ($b_1, \ldots, b_{nb}$) adjusted at the step S204 and outputs the result to the model parameter adjusting unit 105.

At a step 206, the model parameter adjusting unit 105 calculates the absolute value of the error between the operating point ($Q_s'$, $h_{pol}'$) calculated using the open-loop model Rm of the operating point ($Q_s$, $h_{pol}$) obtained from the valve control unit 11, and determines whether or not the absolute value is smaller than or equal to a predetermined threshold.

At the step S206, if the absolute value of the error between the two operating points is larger than the predetermined threshold (No, at the step S206), the flow is returned to the step S204. That is, the model parameter adjusting unit 105 recalculates the model parameters using the least-square method. At the step S206, if the absolute value of the error between the two operating point is smaller than or equal to the predetermined threshold (Yes, at the step S206), the model parameter adjusting unit 105 fixes the model parameter as the parameter to be used (step S207). Further, at a step S208, the upper level module 10A displays on the display unit 13 the values of the fixed model parameters ($a_1, \ldots, a_{na}$) and ($b_1, \ldots, b_{nb}$) and completes the process.

Figure 11:
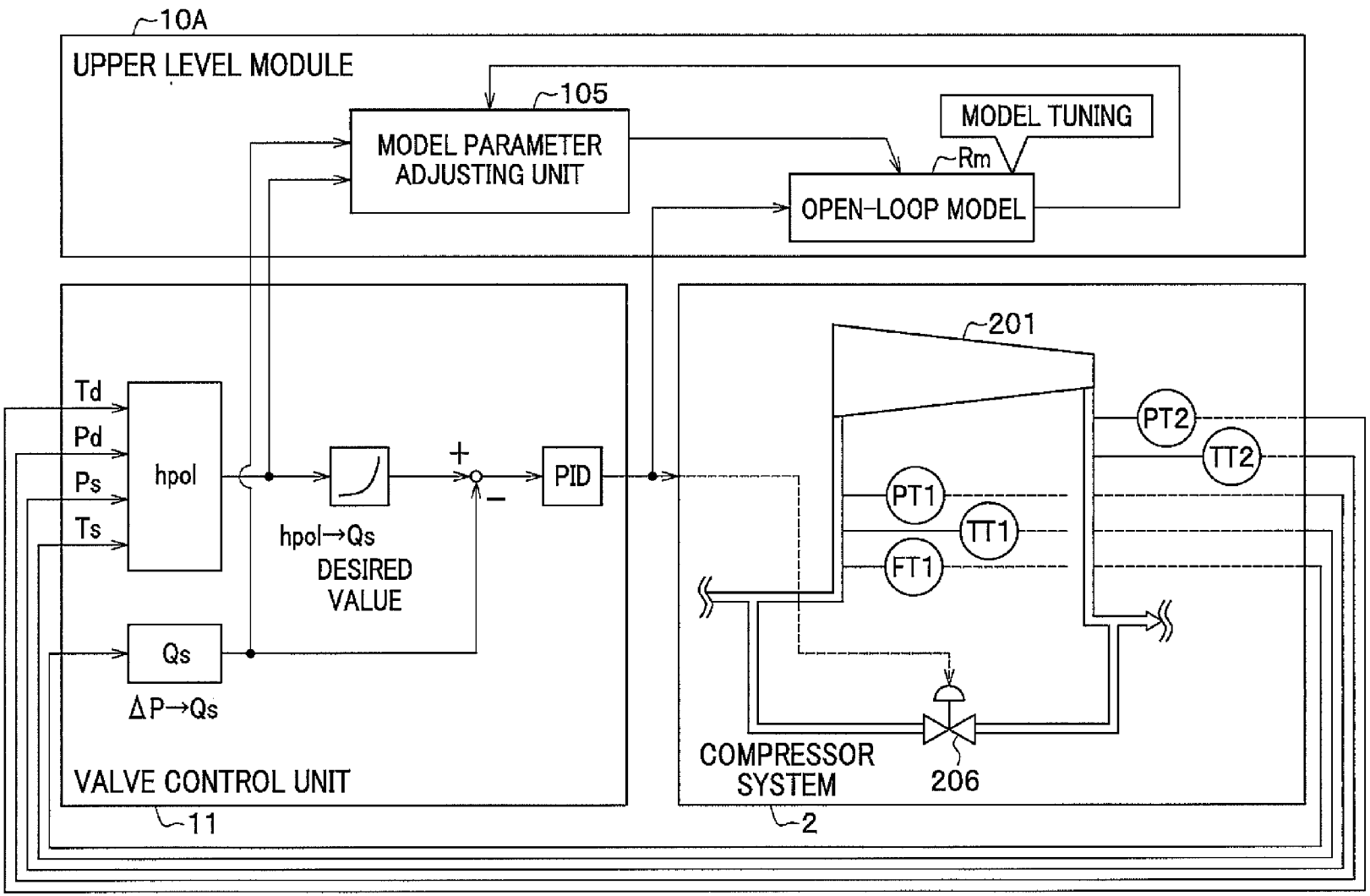
FIG. 11 is a functional diagram of tuning a model parameter using the control device.

FIG. 11 is a functional diagram of tuning a model parameter using the control device.

The control device 1A of the embodiment estimates the open-loop model Rm corresponding to the plant model of the simulation unit 102A, calculates the operating point ($Q_s'$, $h_{pol}'$) using the valve control signal obtained from the valve control unit 11 as the input data u(k), and outputs the result to the model parameter adjusting unit 105.

The model parameter adjusting unit 105 updates the open-loop model Rm until the absolute value of the error between the operating point ($Q_s$, $h_{pol}$) obtained from the compressor system 2 and the operating point ($Q_s'$, $h_{pol}'$) calculated using the open-loop model becomes smaller than or equal to the predetermined threshold.

It is anticipated for the compressor system 2 that the compressor 201 may be deteriorated as the operating time goes by, and the operating condition may be changed. For adjusting the PID parameters of the valve control unit 11, it is required that the simulation unit 102A can appropriately reproduce the behavior of the compressor system 2. Consequently, it is required to adjust the model parameters of the simulation unit 102A in accordance with the change of the operating condition of the compressor system 2.

The control device 1A according to the embodiment can adjust the model parameters such that the behavior of the plant model (the open-loop model Rm) of the simulation unit 102A becomes closer to the behavior of the actual compressor system 2. When performing the auto-tuning of the PID parameters of the valve control unit 11, it is possible to appropriately adjust the PID parameters of the valve control unit 11 by performing the simulation using the plant model that is obtained after the above-mentioned model tuning.

Further, since the control device 1A automatically adjusts the model parameters, it is possible to save the effort of adjustment.

The embodiments of the present invention have been explained above. However, the invention is not limited to those embodiments, and it may be embodied in other various forms within the scope of its technical idea.

For example, in the embodiments above, although a case where a centrifugal compressor is used for the compressor 201 has been explained, the same control device 1 can also be applied to a case where an axial compressor is used for the compressor 201.

In addition, the compressor 201 may be configured with multistage structure as well as single stage structure. For example, when the compressor 2 is configured with two stages, each compressor (for example, compressors 201*a* or 201*b*: not shown) is provided with an anti-surge valve (for example, compressors 206*a* or 206*b*: not shown). In this case, a simulation unit 102 or 102A may be provided corresponding to the configuration, and the PID parameters of the valve control unit 11 may be tuned in accordance with the simulation result.

Further, in each of the embodiments above, although the HQ map representing the relationship of the polytropic head $h_{pol}$ to the suction flow rate $Q_s$ of the compressor has been used for the valve control unit 11, it may also be possible to use a pressure ratio-Q map which shows the relation of the pressure ratio ($p_d/p_s$) to the suction flow rate $Q_s$. of the compressor.

What is claimed is:

1. A control device connectable to control an anti-surge valve that returns fluid on a discharge side of a compressor to a suction side of the compressor in accordance with a control parameter, the control device comprising a computer connectable to input hardware and output hardware and setting the control parameter of a valve control unit that controls the anti-surge valve, wherein the control device is constructed to perform operations to:

perform simulation on an operational status of the compressor in a plant in accordance with the control parameter and a plant model of the plant in which the compressor is installed, wherein the control parameter is a gain of a PI command or a PID control, the plant model is capable of simulating behavior of a actual plant and has an output interface that outputs a process signal calculated by the control device to the valve control unit and an input interface that inputs a control signal from the valve control unit to an anti-surge valve unit model in the plant model, and an actual process signal of the plant is different from the process signal of the plant model;

transmit the control parameter adjusted based on a result of the simulation;

generate a process signal of the plant model for valve control while performing a repeated simulation when the compressor is stopped;

apply a control signal to an anti-surge valve unit model corresponding to the anti-surge valve of the plant model, in accordance with the process signal;

adjust the control parameter until a predetermined termination condition of the process signal is satisfied with regard to the repeated simulation;

control the anti-surge valve on a basis of the control parameter adjusting, when the compressor is working after the simulation, and set the control parameter adjusted by the adjust operation as a control Parameter to be used for anti-surge valve control, wherein the valve control unit can switch a control target, performs a preliminary tuning on a basis of the process signal obtained by performing the simulation, and performs the tuning in a case that a structure of the compressor or a change of operation condition occurs.

2. The control device of the compressor according to claim 1, further comprising the control device constructed to perform operations to:

display the control parameter adjusted by the adjust operation, and set a parameter inputted by a user via the input hardware as a control parameter to be used for anti-surge valve control.

3. The control device of the compressor according to any one of claims 1 and 2, further comprising the control device constructed to perform operations to:

obtain first operating data as a simulation result from the simulation which has obtained a valve control signal to the anti-surge valve, obtain second operating data of the compressor based on the valve control signal, and adjust a model parameter of the plant such that an absolute value of an error between the first operating data and the second operating data becomes equal or smaller than a predetermined value.

4. A control method performed in a control device connectable to control an anti-surge valve that returns fluid on a discharge side of a compressor to a suction side of the compressor in accordance with a control parameter, the control device comprising a computer connectable to input hardware and output hardware and setting the control parameter of a valve control unit that controls the anti-surge valve, wherein the control method comprises operations to:

perform simulation on an operational status of the compressor in a plant in accordance with the control parameter and a plant model of the plant in which the compressor is installed, wherein the control parameter is a gain of a PI command or a PID control, the plant model is capable of simulating behavior of a actual plant and has an output interface that outputs a process signal calculated by the control device to the valve control unit and an input interface that inputs a control signal from the valve control unit to an anti-surge valve unit model in the plant model, and an actual process signal of the plant is different from the process signal of the plant model;

transmit the control parameter adjusted based on a result of the simulation;

generate a process signal of the plant model for valve control while performing a repeated simulation when the compressor is stopped;

apply a control signal to an anti-surge valve unit model corresponding to the anti-surge valve of the plant model, in accordance with the process signal;

adjust the control parameter until a predetermined termination condition of the process signal is satisfied with regard to the repeated simulation;

control the anti-surge valve on a basis of the control parameter adjusting, when the compressor is working after the simulation ends, and set the control parameter adjusted by the adjust operation as a control parameter to be used for anti-surge valve control, wherein the valve control unit can switch a control target, performs a preliminary tuning on a basis of the process signal obtained by performing the simulation, and performs the tuning in a case that a structure of the compressor or a change of operation condition occurs.

5. The control method according to claim 4, further comprising the control device constructed to perform operations to:

display the control parameter adjusted by the adjust operation, and set a parameter inputted by a user via the input hardware as a control parameter to be used for anti-surge valve control.

6. The control method according to any one of claims 4 and 5, further comprising the control device constructed to perform operations to:

obtain first operating data as a simulation result from the simulation which has obtained a valve control signal to the anti-surge valve, obtain second operating data of the compressor based on the valve control signal, and adjust a model parameter of the plant such that an absolute value of an error between the first operating data and the second operating data becomes equal or smaller than a predetermined value.

* * * * *